US007555811B2

(12) United States Patent
Dudderar

(10) Patent No.: US 7,555,811 B2
(45) Date of Patent: Jul. 7, 2009

(54) FLOOR CLEANING APPARATUS EQUIPPED WITH REMOVABLE HALF-PLENUM

(75) Inventor: Raymond P. Dudderar, Stanford, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 804 days.

(21) Appl. No.: 11/191,735

(22) Filed: Jul. 28, 2005

(65) Prior Publication Data

US 2007/0022566 A1 Feb. 1, 2007

(51) Int. Cl.
*A47L 9/22* (2006.01)

(52) U.S. Cl. ..... 15/339; 15/412

(58) Field of Classification Search ..... 14/412, 14/339; *A47L 9/22*

See application file for complete search history.

(56) References Cited

U.S. PATENT DOCUMENTS 4,364,146 A 12/1982 Bowerman
5,983,449 A 11/1999 Thomas et al.
7,383,606 B2 * 6/2008 Barker et al. ..... 15/327.1
2001/0039691 A1 * 11/2001 Bobrosky et al. ..... 15/339

FOREIGN PATENT DOCUMENTS

GB 2387317 10/2003

* cited by examiner

*Primary Examiner*—David A Redding
(74) *Attorney, Agent, or Firm*—King & Schickli, PLLC

(57) ABSTRACT

A floor cleaning apparatus includes a nozzle assembly having a suction inlet and a canister assembly having a housing including a dirt vessel receiver, a wall and a compartment. The wall includes an airpath opening. A dirt collection vessel is held in the receiver and a suction generator is held in the compartment. A plenum connects the airpath opening in the wall with the suction generator. The plenum includes a first section that removably connects to the housing.

18 Claims, 4 Drawing Sheets

FLOOR CLEANING APPARATUS EQUIPPED WITH REMOVABLE HALF-PLENUM

TECHNICAL FIELD

The present invention relates generally to the floor care equipment field and, more particularly, to a floor cleaning apparatus equipped with a plenum to provide efficient airflow between the dirt collection vessel and the suction generator of that apparatus.

BACKGROUND OF THE INVENTION

A vacuum cleaner is an electromechanical appliance utilized to effect the dry removal of dust, dirt and other small debris from carpets, rugs, fabrics or other surfaces in both domestic and industrial environments. In order to achieve the desired dirt and dust removal, a rotary agitator is provided to beat dirt and dust from the nap of the carpet and a pressure drop or vacuum is used to force air entrained with this dirt and dust into the nozzle of the vacuum cleaner. The particulate-laden air is then drawn through a bag-like filter, a dirt cup or a cyclonic separation chamber and filter combination which traps the dirt and dust, while substantially clean air is exhausted by an electrically operated fan that is driven by an onboard motor. It is this fan and motor arrangement that generates the drop in air pressure necessary to provide the desired cleaning action. Thus, the fan and motor arrangement is commonly known as the vacuum or suction generator.

The present invention relates to a floor cleaning apparatus equipped with a plenum for more efficiently and effectively directing air between the dirt collection vessel and the intake of the suction generator. More particularly, the plenum includes a half-plenum or first section that is separate and removable from the housing of the apparatus and a second section that is integrally formed as a portion of that housing. Advantageously, the plenum smoothly and efficiently directs airflow between the dirt collection vessel and the intake of the suction generator so as to enhance vacuum cleaner performance. Additionally, the plenum is relatively inexpensive to produce and both inexpensive and easy to assemble.

SUMMARY OF THE INVENTION

In accordance with the purposes of the present invention as described herein, an improved floor cleaning apparatus is provided. That apparatus comprises a nozzle assembly having a suction inlet and a canister assembly having a housing including a dirt vessel receiver, a wall and a compartment. The wall includes an airpath opening. A dirt collection vessel is held in the receiver and a suction generator is held in the compartment. A plenum is provided to connect the airpath opening in the wall with the suction generator. That plenum includes a first section that removably connects to the housing.

The plenum further includes a second section integrally formed as a portion of the housing. The plenum includes both an inlet opening and an outlet opening. The inlet opening is connected to the airpath opening in the wall and the outlet opening is connected to an intake opening of the suction generator. A first seal is provided between the plenum and the wall to seal the connection between the airpath opening and the inlet opening. A second seal is provided between the plenum and the suction generator to seal the connection between the outlet opening and the intake opening.

In accordance with another aspect of the present invention, the plenum also includes a light source support. Accordingly, a light may be mounted to the outer surface of the plenum. The first section of the plenum also includes a first channel that receives and engages a margin of the second section. Further, the first section includes a second channel and the first and second channels open in opposing directions. In addition the housing includes a removable cover. When the first section of the plenum is positioned with the first channel receiving and engaging a margin of the second section, the cover is positioned so that a fastening rib provided on the cover engages the second channel. Fasteners secure the cover to the housing and thereby simultaneously secure the first section and second section of the plenum together.

In accordance with additional aspects of the present invention, the inlet opening may be entirely provided in the first section of the plenum. Conversely, the outlet opening may be partially provided in the first section and partially provided in the second section. In addition, the apparatus may include a rotary agitator carried on the nozzle assembly and extending at least partially across the suction inlet. Further, the canister assembly may be pivotally connected to the nozzle assembly so that the apparatus takes the form of a standard upright vacuum cleaner or extractor of a type known in the art.

In the following description there is shown and described a preferred embodiment of this invention simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of this specification, illustrates several aspects of the present invention, and together with the description serves to explain certain principles of the invention. In the drawing.

Reference will now be made in detail to the present preferred embodiment of the invention, an example of which is illustrated in the accompanying drawing.

DETAILED DESCRIPTION OF THE INVENTION

Figure 1:
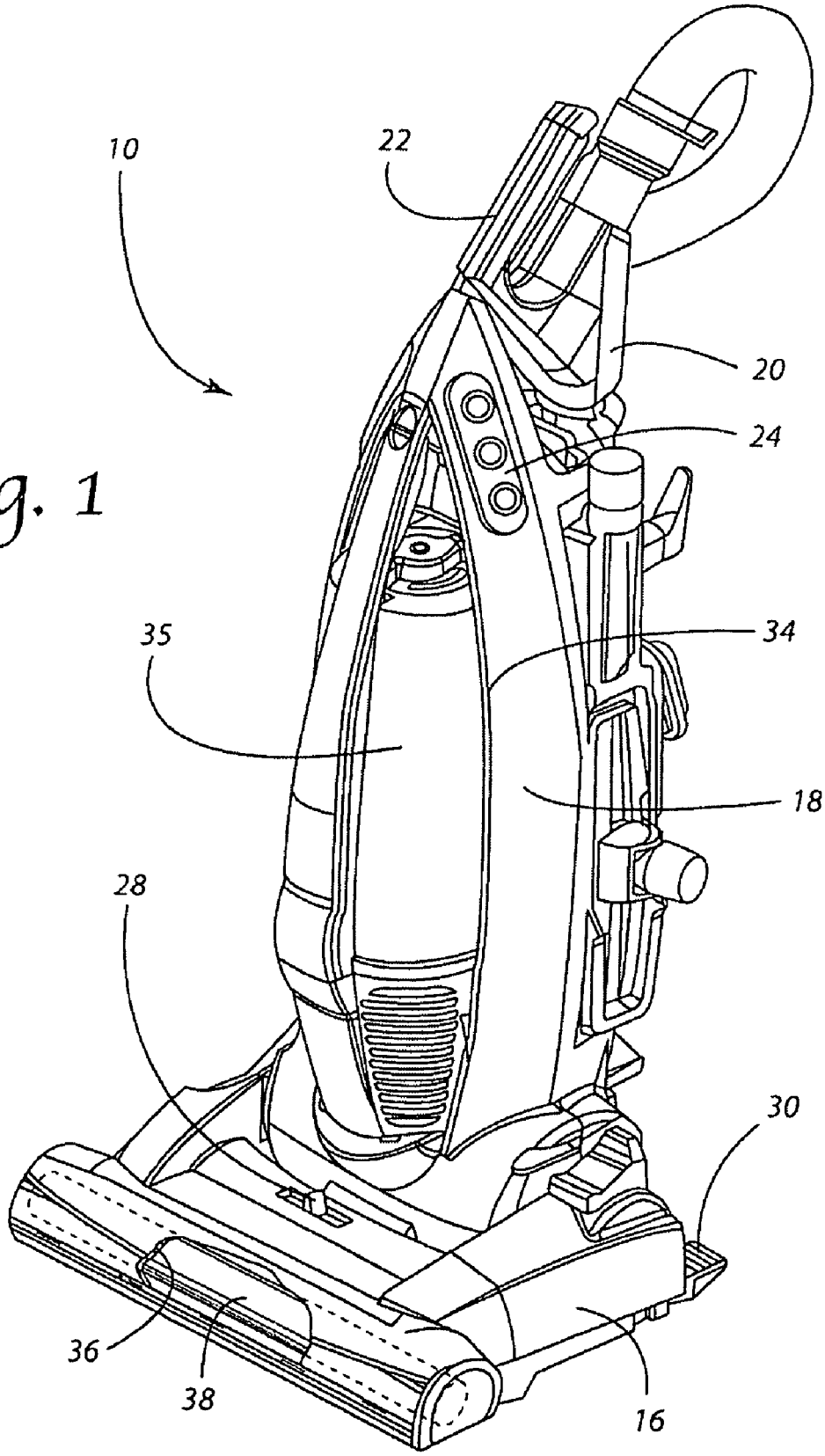
FIG. 1 is a perspective view of an upright vacuum cleaner illustrative of the present invention.
Figure 6:
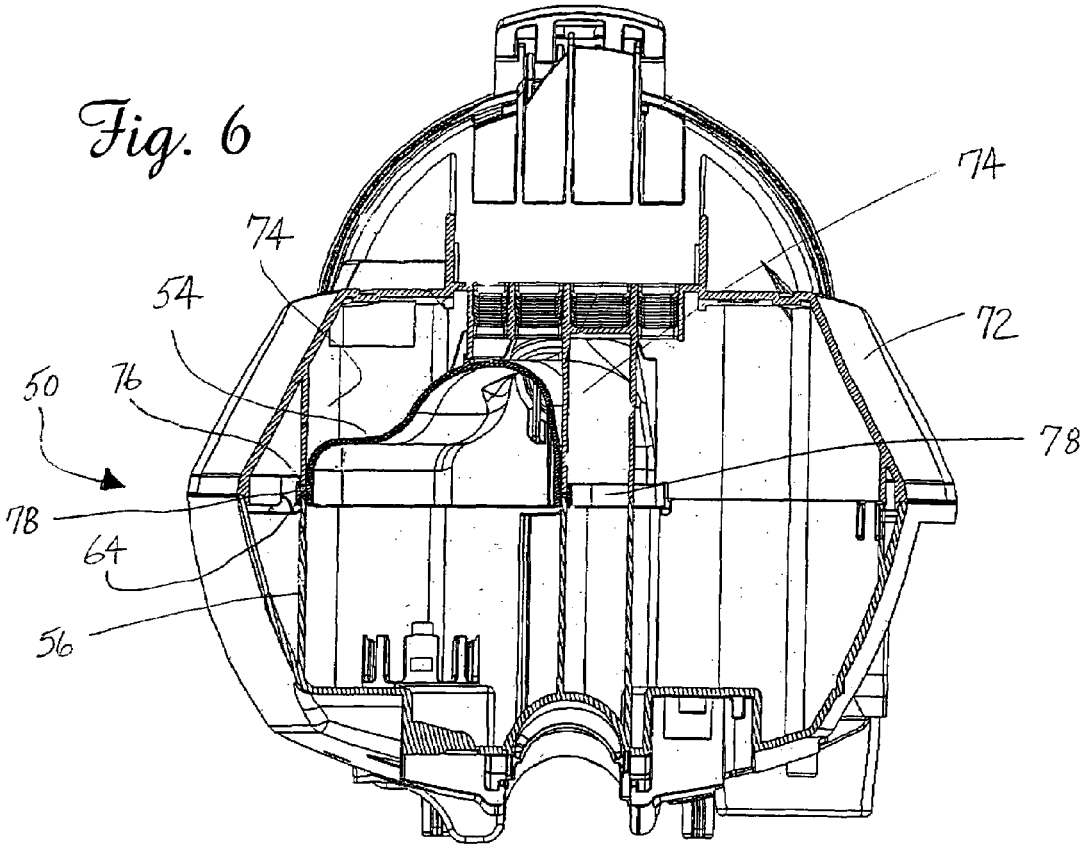
FIG. 6 is a cross-sectional view similar to FIG. 5 but showing how the removable cover engages the second channel on the first section of the plenum to hold the two plenum sections together when the cover is secured to the housing.

Reference is now made to FIG. 1 showing a floor cleaning apparatus 10 of the present invention. As illustrated, that floor cleaning apparatus 10 takes the form of an upright vacuum cleaner. It should be appreciated, however, that the floor cleaning apparatus 10 may also take the form of a canister vacuum cleaner, a hand-held vacuum cleaner or even an extractor.

The overall basic design of the floor cleaning apparatus 10 is generally well known in the art. In the typical arrangement, the floor cleaning apparatus 10 includes a nozzle assembly 16 and a canister assembly 18. The canister assembly 18 further includes a handle 20 and a hand grip 22. A control switch 24 is provided for turning the floor cleaning apparatus 10 on and off. Of course, electrical power is supplied to the floor cleaning apparatus 10 from a standard electrical wall outlet through a cord (not shown). Alternatively, the floor cleaning apparatus 10 could be powered by an onboard battery.

At the lower portion of the canister assembly 18, rear wheels (not shown) are provided to support the weight of the floor cleaning apparatus 10. A second set of wheels (also not shown) allow the operator to raise and lower the nozzle assembly 16 through selective manipulation of the height adjustment switch 28. Such a height adjustment mechanism is well known in the art and is exemplified, for example, by the arrangement incorporated into the Kenmore Progressive vacuum cleaner currently available in the marketplace. To allow for convenient storage of the floor cleaning apparatus 10, a foot latch 30 functions to lock the canister assembly 18 in an upright position, as shown in FIG. 1. When the foot latch 30 is released, the canister assembly 18 may be pivoted relative to the nozzle assembly 16 as the floor cleaning apparatus 10 is manipulated to clean the floor.

The canister assembly 18 also carries an internal chamber 32 that houses a suction generator 33 (i.e. a state of the art fan and motor combination) and a receiver 34 that receives a dirt collection vessel 35 for removing dirt or dust entrained in the air stream as it passes from the nozzle assembly 16 to the suction generator. The canister assembly 18 may also carry a final filtration cartridge (not shown) to trap small particulates and prevent their reintroduction into the environment through the exhaust air stream.

The nozzle assembly 16 includes a nozzle and agitator cavity 36 that houses a rotary agitator 38. In the illustrated floor cleaning apparatus 10, the scrubbing action of the rotary agitator 38 and the negative air pressure created by the suction generator 33 cooperate to brush and beat dirt and dust from the nap of the carpet being cleaned and then draw the dirt and dust laden air from the agitator cavity 36 to the dirt collection vessel 35. Specifically, the dirt and dust laden air passes serially through a suction inlet and hose and/or an integrally molded conduit in the nozzle assembly 16 and/or canister assembly 18 as is known in the art.

Next, the dirt laden air is delivered into the dirt collection vessel 35 held in the receiver 34. The vessel 35 serves to trap the suspended dirt, dust and other particles inside while allowing the now clean air to pass freely. The dirt collection vessel 35 may take the form of a dirt cup as illustrated. If desired, that dirt cup may be cylindrical in shape so as to form a cyclonic airflow chamber. The dirt cup may also include an internal filter (not shown). Alternatively, the dirt collection vessel 35 could be a bag formed from a porous filter media if desired. Essentially substantially any vessel capable of collecting dirt may be utilized.

Next, the air is then drawn from the vessel 35 through an airpath opening 40 in the wall 42. The air then travels through the plenum, generally designated by reference numeral 50, by which the air is efficiently delivered to the intake opening of the suction generator 33. The air passes over the motor of the suction generator 33 to provide cooling before being exhausted into the environment through the final filter.

The plenum 50 will now be described in detail. The plenum 50 includes two sections. The first section 54 is a separate part that is removable from the housing of the canister assembly 18. The second section 56 is integrally formed as a portion of the housing. In fact, the second section 56 in the illustrated embodiment is formed from structural ribs molded at the time of the formation of the housing.

Figure 2:
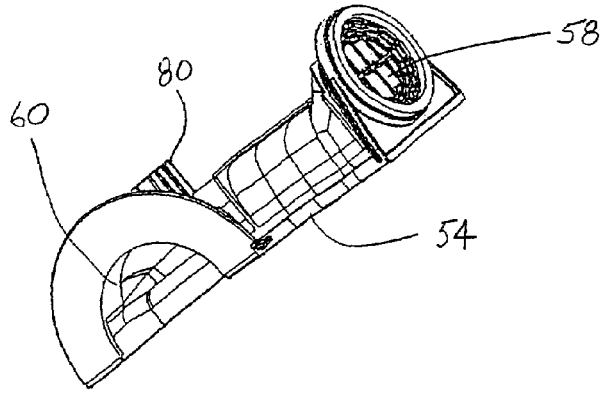
FIG. 2 is a detailed, perspective view of the first section of the plenum.

The plenum 50 includes an inlet opening 58 and an outlet opening 60. As should be appreciated from reviewing FIGS. 2 and 4, the inlet opening 58 is wholly provided in the first section 54 of the plenum 50 while the outlet opening 60 is partially provided in the first section 54 and partially provided in the second section 56.

Figure 3:
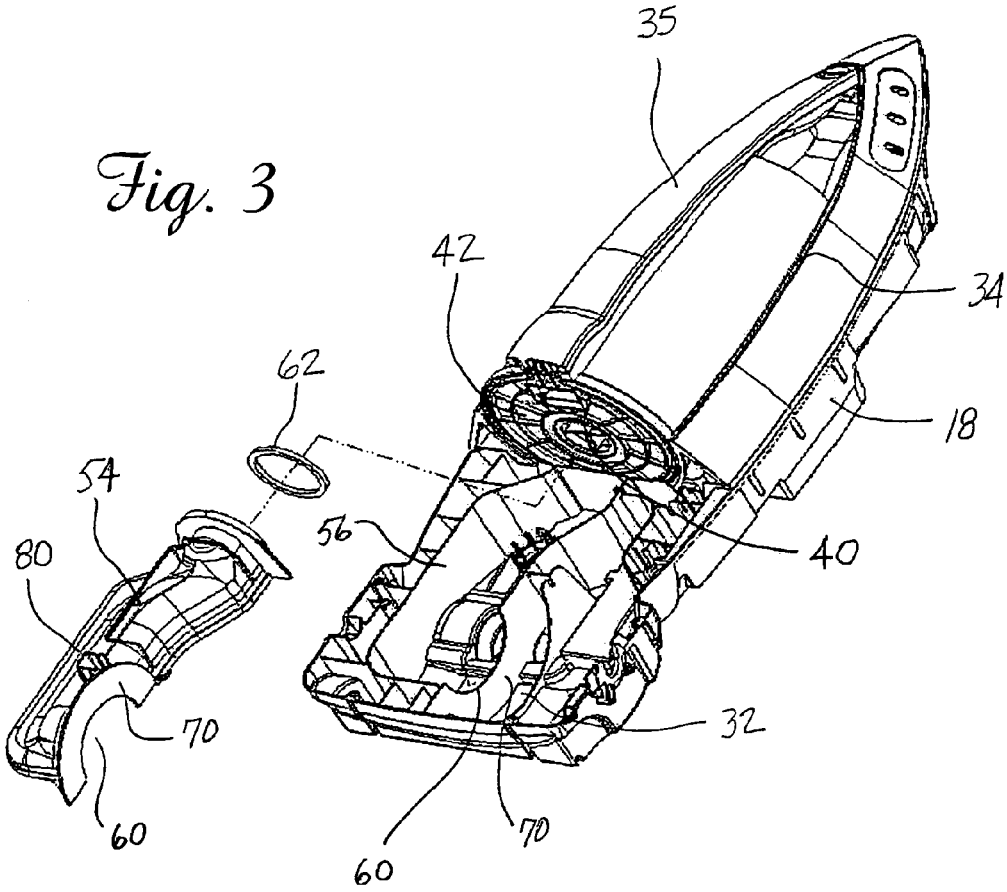
FIG. 3 is a detailed, partially exploded view illustrating the canister assembly holding the dirt collection vessel and receiving the first section of the plenum.

The assembly of the plenum 50 is illustrated with reference to FIGS. 3-6. As illustrated in FIG. 3, the first section 54 and second section 56 mate to form the plenum 50. More specifically, the inlet opening 58 in the first section 54 engages the wall 42 with the inlet opening aligned with the airpath opening 40 in that wall. A seal 62, such as a rubber O-ring, is provided between the first section 54 and wall 42 around the airpath opening 40 and inlet opening 58 in order to complete an airtight connection.

Figure 5:
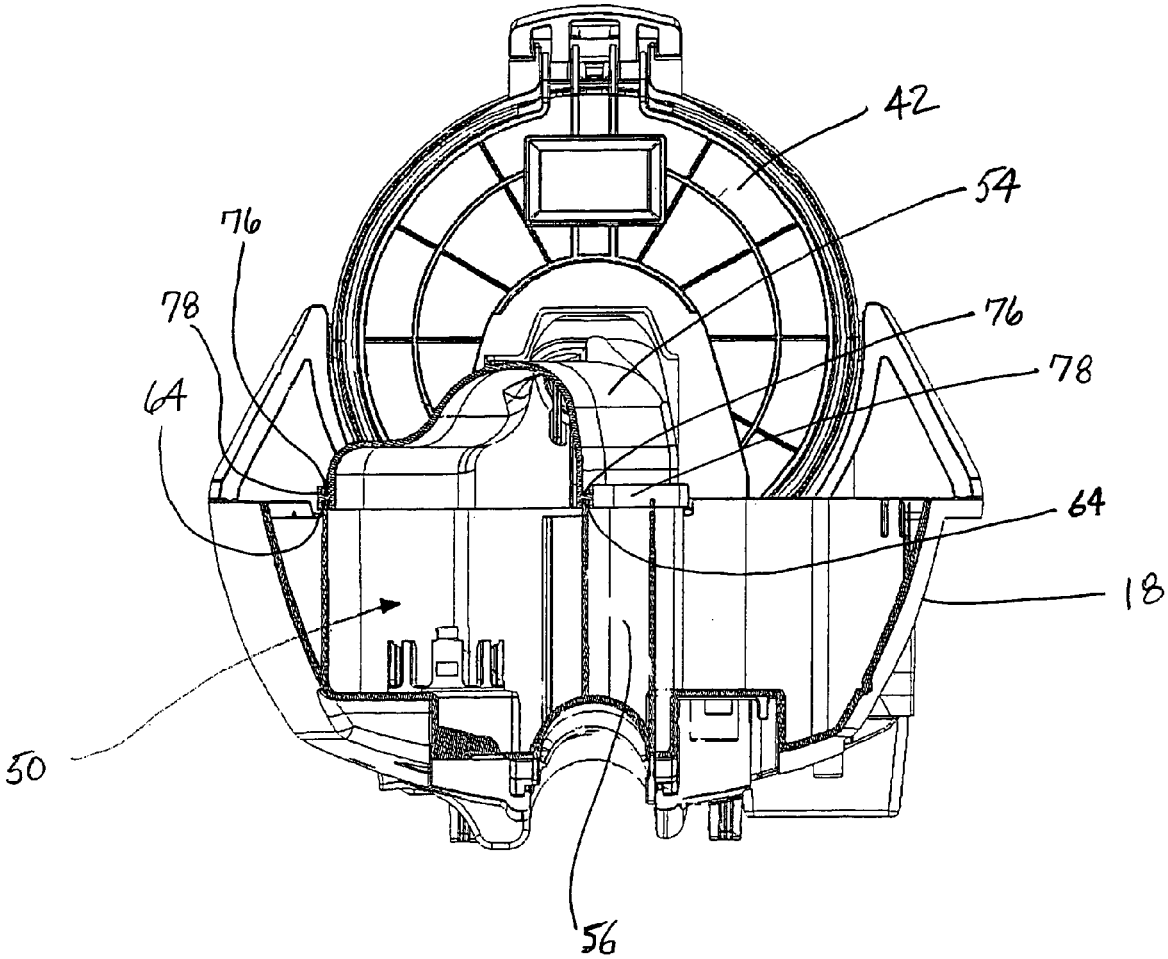
FIG. 5 is a cross-sectional view illustrating how the first channel of the first section of the plenum engages the margin of the second section of the plenum.

FIG. 5 is a detailed cross-sectional view illustrating the structure for mating the first section 54 with the second section 56. As illustrated, the first section 54 includes a first channel 64 around its entire edge. The first channel 64 receives and engages a margin of the second section 56. When properly seated, the margin of the second section 56 engages the bottom of the first channel 64 around the entire mating periphery of the two sections. A seal (not shown) of rubber or other appropriate material may be provided in the channel 64 if desired.

Figure 4:
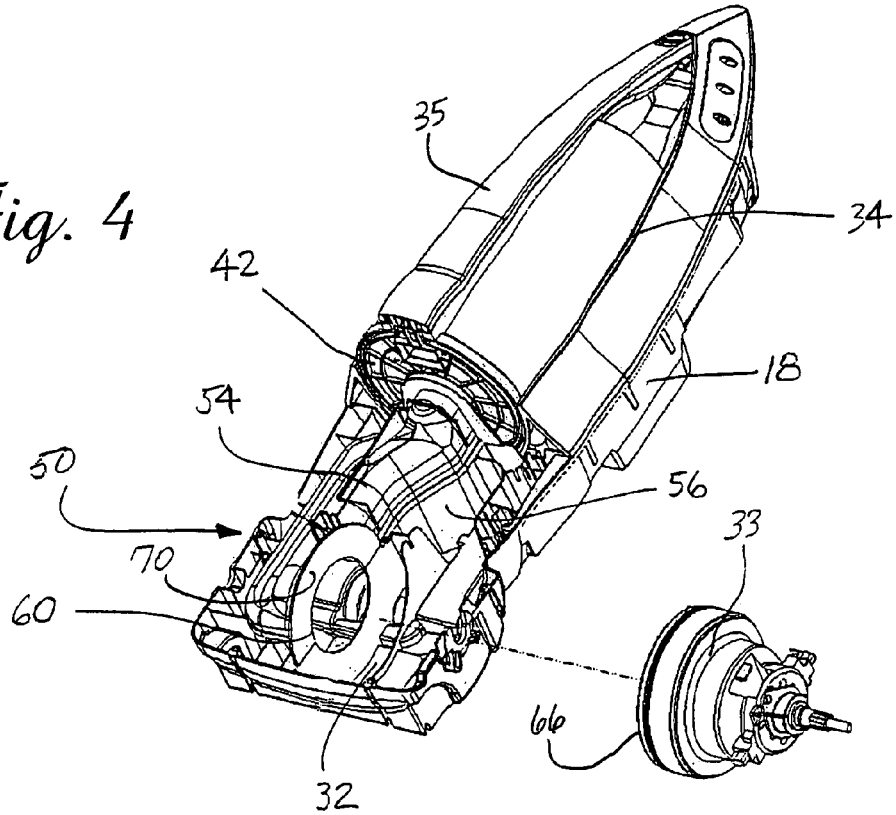
FIG. 4 is a detailed perspective view similar to FIG. 3 illustrating the first section of the plenum mated with the second section of the plenum and the installation of the suction generator.

When the first section 54 is fully seated on the second section 56 as illustrated in FIG. 4, the suction generator 33 is mounted in the internal chamber 32. An annular ring 66 of low durometer rubber is provided around an intake opening of the suction generator. This ring engages the face 70 of the plenum 50 around the outlet opening 60 thereby providing an airtight seal between the outlet opening 60 and the intake opening.

Once the suction generator 33 has been installed and properly seated in the chamber 32, the removable cover 72 is fastened to the housing of the canister assembly 18 by fasteners such as resilient clips, screws or the like of a type well known in the art. This simultaneously serves to secure the first section 54 to the second section 56 of the plenum 50. More specifically, fastening ribs 74 molded in the removable cover 72 engage and are held in a second channel 76 provided on the first section 54. As clearly illustrated in FIG. 6, the first and second channels 64, 76 open in opposing directions. As clearly illustrated the outer flange or band 78 of the first section 54 defining the channels 64, 76 insures that the first section 54 remains captured between the fastening ribs 74 and the second section 56 thereby completing a fastener-less connection of the two sections of the plenum 50.

In accordance with an additional aspect of the present invention, the first section 54 of the plenum 50 may also be provided with a light source support 80. It should be appreciated that during assembly, a light source (not shown) may be anchored to the light source support 80 and electrically connected by appropriate wiring to the control switch 24 of the floor cleaning apparatus 10. Where the cover 72 is made from or incorporates a window made from a translucent or transparent material, such a light source provides lighting to the area of the floor being cleaned with the floor cleaning appliance. This is a significant benefit for a user using the device to clean a floor in a poorly lit room or in a room with dark shadows generated by furniture.

The foregoing description of a preferred embodiment of the present invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiments do not and are not intended to limit the ordinary meaning of the claims and their fair and broad interpretation in any way.

What is claimed is:

1. A floor cleaning apparatus, comprising:

a nozzle assembly having a suction inlet;

a canister assembly having a housing including a dirt vessel receiver, a wall and a compartment, said wall including an airpath opening;

a dirt collection vessel held in said receiver;

a suction generator held in said compartment;

a plenum connecting said airpath opening in said wall with said suction generator, said plenum including a first section that removably connects to said housing and a light source support.

2. The floor cleaning apparatus of claim 1 wherein said plenum further includes a second section integrally formed as a portion of said housing, said first and second sections mating together and forming said plenum.

3. The floor cleaning apparatus of claim 2, wherein said plenum further includes an inlet opening and an outlet opening.

4. The floor cleaning apparatus of claim 3, wherein said inlet opening is connected to said airpath opening in said wall and said outlet opening is connected to an intake opening of said suction generator.

5. The floor cleaning apparatus of claim 4, wherein a first seal is provided between said plenum and said wall to seal the connection between said airpath opening and said inlet opening.

6. The floor cleaning apparatus of claim 5, wherein a second seal is provided between said plenum and said suction generator to seal the connection between said outlet opening and said intake opening.

7. The floor cleaning apparatus of claim 2, wherein said first section includes a first channel that receives and engages a margin of said second section.

8. The floor cleaning apparatus of claim 7, wherein said housing includes a removable cover.

9. A floor cleaning apparatus, comprising:

a nozzle assembly having a suction inlet;

a canister assembly having a housing including, a removable cover, a dirt vessel receiver, a wall and a compartment, said wall including an airpath opening;

a dirt collection vessel held in said receiver;

a suction generator held in said compartment;

a plenum connecting said airpath opening in said wall with said suction generator, said plenum including a first section that removably connects to said housing and a second section integrally formed as a portion of said housing, said first section including a first channel that receives and engages a margin of said second section and said first section further including a second channel that engages a fastening rib provided on said cover.

10. The floor cleaning apparatus of claim 9, wherein said first channel and said second channel open in opposing directions.

11. The floor cleaning apparatus of claim 3, wherein said inlet opening is provided in said first section of said plenum.

12. A floor cleaning apparatus, comprising:

a nozzle assembly having a suction inlet;

a canister assembly having a housing including a dirt vessel receiver, a wall and a compartment, said wall including an airpath opening;

a dirt collection vessel held in said receiver;

a suction generator held in said compartment;

a plenum connecting said airpath opening in said wall with said suction generator, said plenum including a first section that removably connects to said housing and a second section integrally formed as a portion of said housing, said plenum further including an inlet opening provided in said first section and an outlet opening partially provided in said first section and partially provided in said second section.

13. The floor cleaning apparatus of claim 1, further including a rotary agitator carried on said nozzle assembly and extending at least partially across said suction inlet.

14. The floor cleaning apparatus of claim 1, wherein said canister assembly is pivotally connected to said nozzle assembly.

15. The floor cleaning apparatus of claim 1, wherein said plenum further includes an inlet opening and an outlet opening.

16. The floor cleaning apparatus of claim 15, wherein said inlet opening is connected to said airpath opening in said wall and said outlet opening is connected to an intake opening of said suction generator.

17. The floor cleaning apparatus of claim 16, wherein a first seal is provided between said plenum and said wall to seal the connection between said airpath opening and said inlet opening.

18. The floor cleaning apparatus of claim 17, wherein a second seal is provided between said plenum and said suction generator to seal the connection between said outlet opening and said intake opening.

* * * * *